US008695135B2

(12) United States Patent
Berube

(10) Patent No.: US 8,695,135 B2
(45) Date of Patent: Apr. 15, 2014

(54) SACRUM SUPPORT PILLOW

(71) Applicant: Daniel James Berube, Salem, NH (US)

(72) Inventor: Daniel James Berube, Salem, NH (US)

( * ) Notice: Subject to any disclaimer, the term of this patent is extended or adjusted under 35 U.S.C. 154(b) by 0 days.

(21) Appl. No.: 13/894,794

(22) Filed: May 15, 2013

(65) Prior Publication Data

US 2013/0312195 A1 Nov. 28, 2013

Related U.S. Application Data

(60) Provisional application No. 61/647,935, filed on May 16, 2012.

(51) Int. Cl.
*A47G 9/10* (2006.01)

(52) U.S. Cl.
USPC ..... 5/648; 5/630

(58) Field of Classification Search
USPC ..... 5/648, 630, 632, 633, 621, 624, 652, 5/653; 297/230.1, 230.13, 250.1, 452.1, 297/452.21, 452.29; D6/601
See application file for complete search history.

(56) References Cited

U.S. PATENT DOCUMENTS

| | | | | |
|---|---|---|---|---|
| 595,527 | A | 12/1897 | Cordeiro | |
| 4,156,544 | A | 5/1979 | Swenson et al. | |
| D259,381 | S * | 6/1981 | Smith | D6/601 |
| 4,316,631 | A | 2/1982 | Lenz et al. | |
| 4,487,201 | A | 12/1984 | Ciambarella et al. | |
| 4,572,578 | A | 2/1986 | Perkins | |
| 4,597,386 | A | 7/1986 | Goldstein | |
| 4,634,176 | A | 1/1987 | Scott | |
| 4,679,262 | A * | 7/1987 | Davis et al. | 5/644 |
| 4,718,724 | A | 1/1988 | Quinton et al. | |
| 4,835,801 | A | 6/1989 | Walpin et al. | |
| 4,876,755 | A | 10/1989 | Parrish | |
| 5,114,209 | A | 5/1992 | Dunn | |
| 5,201,761 | A | 4/1993 | Serola | |
| 5,214,816 | A * | 6/1993 | Collins | 5/656 |
| 5,314,235 | A | 5/1994 | Johnson | |
| 5,432,967 | A * | 7/1995 | Raftery | 5/633 |
| 5,456,519 | A | 10/1995 | Davis | |
| 5,520,624 | A | 5/1996 | Amato | |
| 5,533,787 | A | 7/1996 | Xiang | |
| 5,544,377 | A | 8/1996 | Gostine | |
| 5,664,271 | A * | 9/1997 | Bellavance | 5/632 |
| 6,132,004 | A | 10/2000 | Carlino | |
| 6,241,320 | B1 | 6/2001 | Chew et al. | |
| 6,532,962 | B1 | 3/2003 | Walker et al. | |
| 6,817,673 | B2 | 11/2004 | Walker et al. | |
| 7,210,178 | B2 | 5/2007 | DiGirolamo | |
| 7,225,485 | B2 | 6/2007 | Binder | |
| 7,309,104 | B2 | 12/2007 | Browne et al. | |
| 7,413,250 | B2 | 8/2008 | Connolly et al. | |
| 7,437,789 | B2 | 10/2008 | Thompson | |
| 7,537,286 | B2 | 5/2009 | Walker et al. | |

(Continued)

*Primary Examiner* — Robert G Santos
(74) *Attorney, Agent, or Firm* — Bourque and Associates, PA

(57) ABSTRACT

A sacrum support pillow comprises a three-sided deformable member having a length and a width. The length defines a central region disposed between first and second ends. The width in the central region is greater than the width in the first and second ends such that the width tapers to points near the first and second ends. The three sided deformable member defines three edges, and wherein a deformable member surface is located between the first and second edges, the second and third edges, and the third and first edges, and wherein each surface is concave and may have a different width. An outer covering encloses the three sided deformable member.

12 Claims, 1 Drawing Sheet

(56) References Cited

U.S. PATENT DOCUMENTS

| | | | |
|---|---|---|---|
| 7,789,461 | B2 | 9/2010 | Leeds |
| 2003/0229378 | A1 | 12/2003 | Weber |
| 2005/0150051 | A1 | 7/2005 | Greenawalt et al. |
| 2005/0257320 | A1 | 11/2005 | Mollett |
| 2006/0143830 | A1 | 7/2006 | Bair |
| 2006/0152052 | A1 | 7/2006 | Billger et al. |
| 2006/0250015 | A1 | 11/2006 | Buck |
| 2008/0290701 | A1 | 11/2008 | Adamyan |
| 2008/0315644 | A1 | 12/2008 | Briscoe |
| 2009/0025145 | A1 | 1/2009 | Tuffin et al. |
| 2009/0307846 | A1 | 12/2009 | Eura et al. |
| 2010/0121377 | A1 | 5/2010 | Held |
| 2010/0263127 | A1 | 10/2010 | Jamshidi |
| 2010/0319132 | A1 | 12/2010 | Li |
| 2011/0094034 | A1 | 4/2011 | Cortright |
| 2011/0105970 | A1 | 5/2011 | Gainer, Jr. |
| 2013/0312195 | A1* | 11/2013 | Berube ..... 5/648 |

* cited by examiner

SACRUM SUPPORT PILLOW

CROSS-REFERENCE TO RELATED APPLICATIONS

This application claims priority from U.S. provisional patent application 61/647,935, filed May 16, 2012, incorporated fully herein by reference.

TECHNICAL FIELD

The present invention relates to lower back support pillows and more particularly, relates to a memory foam sacrum support pillow for use in any type of seat.

BACKGROUND INFORMATION

Many individuals today spend a considerable amount of time seated at work, school, home and/or while traveling. This time includes time spent seated continuously in an office or school chair or hours spent seated during a lengthy commute to and from work.

In humans, the sacrum is a large, triangular bone at the base of the spine and at the upper and back part of the pelvic cavity, where it is inserted like a wedge between the two hip bones. Its upper part connects with the last lumbar vertebrae, and bottom part with the coccyx or tailbone. While seated, the sacrum typically rests against the back of the seat area and against the bottom portion of the seat. A majority of the user's weight is generally resting on this area of the body.

Accordingly, what is needed is a portable and inexpensive support, such as a pillow, that a user can install on generally any seat to help cushion and support the weight of the user's body on the user's sacrum.

SUMMARY

The invention features a sacrum support pillow comprising a three-sided deformable member having a length and a width. The length defines a central region disposed between first and second ends. In one embodiment, the width in the central region is greater than the width in the first and second ends. The three sided deformable member defines three edges, and wherein a deformable member surface disposed between the first and second edges, the second and third edges, and the third and first edges each have, in one embodiment, a concave surface.

An outer covering encloses the three sided deformable member. In one embodiment, the outer covering is selected from the group consisting of cloth, fabric, leather and vinyl. The three-sided deformable member may be generally triangular in cross-section in the central region, and wherein the width in the central region of the deformable member tapers to a point towards the first and second ends respectively. In one embodiment, each of the three deformable member surfaces have a width which is different from one another.

BRIEF DESCRIPTION OF THE DRAWINGS

These and other features and advantages of the present invention will be better understood by reading the following detailed description, taken together with the drawings wherein.

DETAILED DESCRIPTION OF THE PREFERRED EMBODIMENTS

Figure 1:
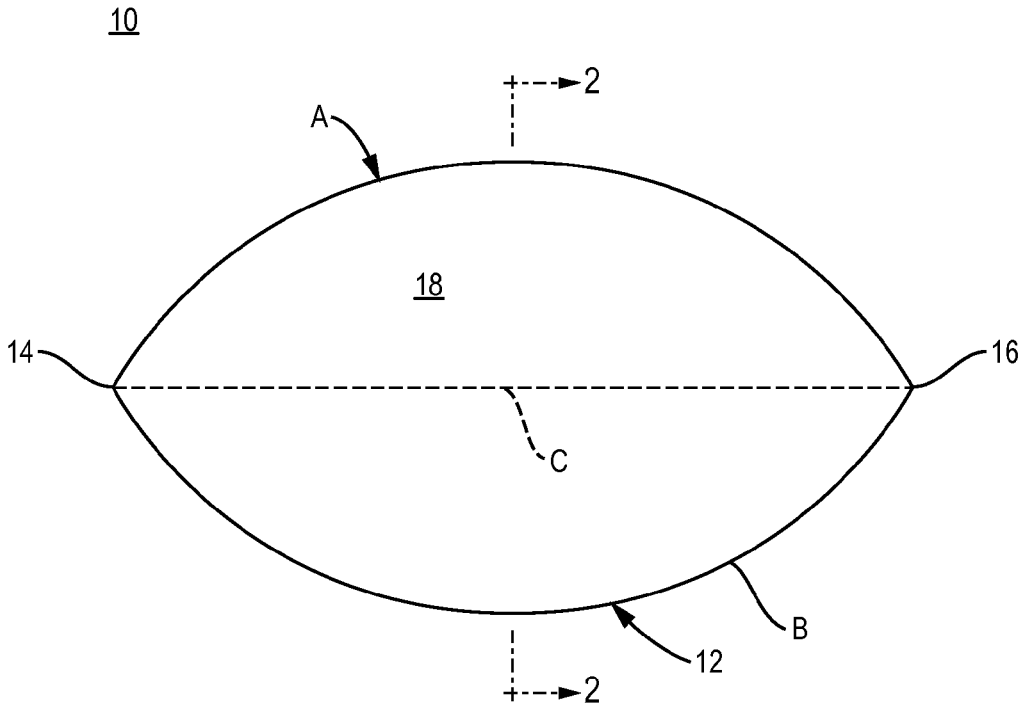
FIG. 1 is a front perspective view of the sacrum support pillow. According to the present invention.

The present invention features a pillow 10, FIG. 1, having a unique shape and contour and which is designed to be placed in the joint area of a seat between the seat bottom and the seat back, to appropriately and adequately support the sacrum area of a user's skeletal structure. In the preferred embodiment, the sacrum pillow 10 is made of a memory foam material, although this is not a limitation of the present invention as any appropriate material having sufficient density yet providing sufficient support is considered to be within the scope of the present invention. The flexibility of the memory foam will allow it to contour to almost any shape seat design when pressure is applied by the person utilizing it.

The pillow may be manufactured by either cutting the desired shape from a large block of foam or other suitable material or alternatively, the foam could be molded into the shape desired. In the preferred embodiment, the pillow itself 10 is covered by an outer covering 18, which may be cloth, fabric, leather, vinyl or other similar material. The outer covering 18 serves to keep the pillow clean, the covering material may help keep it from shifting and in addition, also allows for providing various styles and other stylistic effects such as color, pattern, brand name, logo or the like. The outer covering 18 will generally be manufactured in sections and sewed, stitched, glued or otherwise formed into the proper desired shape and size and placed around the pillow.

The foam which is utilized to form the sacrum support pillow of the present invention will be cut or formed in a generally overall triangular shape as shown in FIG. 1, wherein, in one embodiment, the central region 12 of the pillow is wider than the in the end or tip portions 14, 16. Accordingly, the pillow tapers towards the ends 14, 16. For exemplary purposes only, the overall length of the pillow from tip 14 to tip 16 is preferably approximately 16 inches while the "thickness" of the pillow from end point or tip C (FIGS. 2) to the most concave point of the side that extends between endpoints A and B is approximately 3.5 inches. Thus, most of the material of the pillow will be in the middle of the triangular shaped pillow placing most of the support in the sacrum area of the user's frame. The pillow 10 will look almost symmetrical looking at it from the end while looking almost seamless from the front as it tapers into the seat in all directions.

Figure 2:
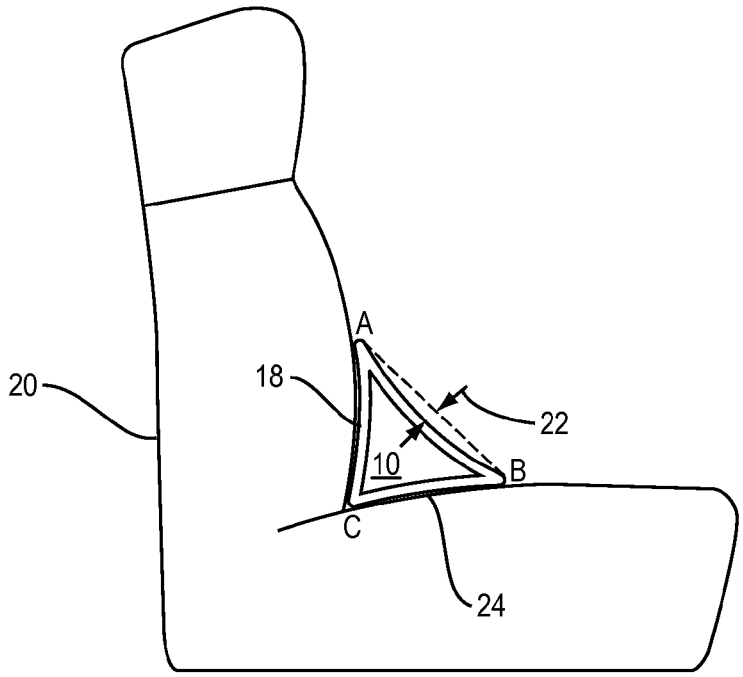
FIG. 2 is a cross-sectional view taken along lines 2-2 of the sacrum pillow shown in FIG. 1.

As shown in cross-section in FIG. 2, the pillow 10 according to the present invention includes 3 sides: the first side which is designated between points A and B is designed to face outward, away from seat 20 and against the sacrum region of the user (not shown). An exemplary length of this side (between end points A and B) is between 10 and 11 inches. It should be noted that in one embodiment, side A-B, as well as one or more additional sides of the pillow 10, may include a surface that is slightly concave as shown by arrow 22.

The second side, which is designated as the side defined between end points B and C, is sized and designed to rest against the seat bottom portion 24. This side may also be slightly concave and has an overall preferred length (between end points B and C) of between 6 and 7 inches.

Lastly, the third side, defined between points A and C is sized, shaped and designed to rest against the seat back portion 20, with point C designed to fit in the space or opening between the seat back portion 20 and the seat bottom portion

24, keeping the pillow generally in place. This side may also be slightly concave and has an overall preferred length (between end points A and C) of between approximately 4.5 and 5.5 inches. The shape of the pillow 10 according to the present invention is important as the taper provided by side A-C provides for less and less support for the user into the lumbar area of the back (above end point A) which support is generally provided by other in-seat or external mechanisms.

In order to use the sacrum pillow 10 of the invention, the user simply places the pillow 10 in the area between the seat bottom 24 and seat back 20, essentially wedging the endpoint C into the space or opening between the seat bottom 24 and back 20. When the pillow is made of memory foam, the user merely sits against the pillow for a moment or two while the memory foam "contours" to the user's sacrum area, locking in the pillow 10 into the seat while the user is sitting against it. As the foam contours to the body and seat, the pillow 10 becomes more stable.

Accordingly, the present invention provides a sacrum pillow, preferably a memory foam sacrum pillow that is effective, portable, removable and which provides the necessary sacrum area support for a user while seated. The same pillow can be used by various individuals and will simply contour to each individual who rests against it.

Modifications and substitutions by one of ordinary skill in the art are considered to be within the scope of the present invention, which is not to be limited except by the allowed claims and their legal equivalents.

The invention claimed is:

1. A sacrum support pillow, comprising:

a three-sided deformable member having a length and a width, said length defining a central region disposed between first and second ends, said width in said central region being greater than said width in said first and second ends, said three sided deformable member defining three edges, and wherein a deformable member surface disposed between said first and second edges, said second and third edges, and said third and first edges each have a concave surface; and an outer covering enclosing said three sided deformable member.

2. The support pillow of claim 1, wherein said outer covering is selected from the group consisting of cloth, fabric, leather and vinyl.

3. The support pillow of claim 1, wherein said three-sided deformable member is generally triangular in cross-section in said central region.

4. The support pillow of claim 1, wherein said width in said central region of said deformable member tapers to a point towards said first and second ends respectively.

5. The support pillow of claim 1, wherein each of said three deformable member surfaces have a width which is different from one another.

6. A sacrum support pillow, comprising:

a three-sided deformable member having a length and a width, said length defining a central region disposed between first and second ends, said width in said central region being greater than said width in said first and second ends, said three sided deformable member defining three edges, wherein a deformable member surface is disposed between said first and second edges, said second and third edges, and said third and first edges, and wherein at least one of said deformable member surfaces disposed between said first and second edges, said second and third edges, and said third and first edges has a concave surface; and an outer covering enclosing said three sided deformable member.

7. The support pillow of claim 6, wherein at least two of said deformable member surfaces disposed between said first and second edges, said second and third edges, and said third and first edges have a concave surface.

8. The support pillow of claim 6, wherein each of said deformable member surfaces disposed between said first and second edges, said second and third edges, and said third and first edges each has a concave surface.

9. The support pillow of claim 6, wherein said outer covering is selected from the group consisting of cloth, fabric, leather and vinyl.

10. The support pillow of claim 6, wherein said three-sided deformable member is generally triangular in cross-section in said central region.

11. The support pillow of claim 6, wherein said width in said central region of said deformable member tapers to a point towards said first and second ends respectively.

12. The support pillow of claim 6, wherein each of said three deformable member surfaces have a width which is different from one another.

* * * * *